United States Patent [19]

Ito et al.

[11] Patent Number: 4,597,071

[45] Date of Patent: Jun. 24, 1986

[54] PICKUP CARTRIDGE OF MOVING MAGNET TYPE

[75] Inventors: Tsugio Ito; Shigeru Fujita, both of Hamamatsu, Japan

[73] Assignee: Nippon Gakki Seizo Kabushiki Kaisha, Hamamatsu, Japan

[21] Appl. No.: 498,172

[22] Filed: May 25, 1983

[30] Foreign Application Priority Data

May 31, 1982 [JP] Japan ..... 57-80271[U]

[51] Int. Cl.[4] ..... H04R 11/12

[52] U.S. Cl. ..... 369/136; 369/146; 369/149

[58] Field of Search ..... 358/136, 139, 146, 147, 358/149

[56] References Cited

U.S. PATENT DOCUMENTS

| | | | |
|---|---|---|---|
| 3,627,931 | 12/1971 | Matsuda | 369/136 |
| 4,177,360 | 12/1979 | Fujimoto et al. | 369/136 |
| 4,345,322 | 8/1982 | Aizawa et al. | 369/139 |
| 4,352,176 | 9/1982 | Itoh | 369/139 X |

*Primary Examiner*—Aristotelis M. Psitos

*Attorney, Agent, or Firm*—Cushman, Darby & Cushman

[57] ABSTRACT

A moving magnetic pickup cartridge including: a vibratory system having; a stylus arm in a cantilever fashion, a stylus being provided at a free end of the stylus arm, and a permanent magnet being provided at a fixed end of the stylus arm, the magnet being magnetized in a direction of an axis of the stylus arm; a magnetoelectric converting system including; a stationary core having first, second and third yoke members magnetically coupled at their one pole ends to each other, the first and second yoke members having their other pole ends face respective lateral peripheral sides of the permanent magnet while the third yoke member has its other pole end facing an upper periphery of the magnet; and a coil system which includes at least two sets of coils, each set of which is wound around the first, second and third yoke members, one set of coils producing a sum of a horizontal signal and a vertical signal corresponding respectively to a horizontal component and a vertical component of the magnet vibration, the other set of coils producing a difference between the horizontal and vertical signals.

9 Claims, 14 Drawing Figures

PICKUP CARTRIDGE OF MOVING MAGNET TYPE

BACKGROUND OF THE INVENTION

The present invention relates to pickup cartridges of the moving magnet type.

As is well known, in the 45-45 system records, the recording groove consists of two side walls disposed at 45° to the record plane, in one of the side walls being recorded left channel signals and in the other being recorded right channel signals. Many approaches have been proposed to derive signals of both channels of records of this system. Among them there is an approach in which when a stylus of a pickup cartridge traces the record groove, a signal corresponding to the horizontal component of the stylus vibratory motion and that corresponding to the vertical component thereof are detected separately, and then processed to obtain right and left channel signals. More specifically, in signals of the 45-45 system record, there are the following relationships:

$$EH=EL+ER \quad (1)$$

$$EV=EL-ER \quad (2)$$

where EL is a left channel signal, ER is a right channel signal, EH is a signal corresponding to the horizontal vibratory component, and EV is a signal corresponding to the vertical vibratory component. The sum Ea of and the difference Eb between the signals EH and EV provide $$Ea=EH+EV \quad (3)$$

$$Eb=EH-EV \quad (4)$$

From the equations (1) to (4), $$Ea=2EL \quad (5)$$

$$Eb=2ER \quad (6)$$

Thus the right and left channel signals are obtained based on the signals EH and EV.

This method has been applied to pickup cartridges of the moving magnet type, and such pickup cartridges have already been put into commercial use. In this kind of moving magnet type pickup cartridge, a cantilever arm or stylus arm carring a stylus at its free end has a permanent magnet attached at its fixed end, and around the magnet there are disposed yokes, having coils wound around them, for separately detecting a horizontal component of the magnet vibratory motion and a vertical component thereof. More specifically, the yokes for detecting the horizontal vibratory component are disposed on the lateral sides of the magnet and the yokes for detecting the vertical vibratory component are disposed above and below the magnet whereby the vertical and horizontal components are efficiently detected. With such construction the pickup cartridge has an overall shape having the lower portion thereof projected downwards since one of yokes for detecting the vertical component of the magnet vibratory motion is disposed below the magnet, and hence it is necessary to increase the length of the stylus arm to prevent the casing of the pickup cartridge from coming into contact with the record disc. However, increase in the length of the stylus arm provides disadvantages in that the equivalent mass of the vibratory system increases, which results in the narrowing of its reproduction band in high frequency range, and in that the rotation angle of the stylus arm is reduced with the result that output voltages of the coils drop.

For eliminating such disadvantages of the pickup cartridge of the moving magnet type adopting the above-described electrical signal producing system, there has been proposed a pickup cartridge, shown in FIGS. 1 and 2, having its casing not projected downwards. (see U.S. Pat. No. 4,177,360 to Fujimoto et al.) In this pickup cartridge, stylus arm 2 carrying a stylus 1 at its one end is attached at the other end to a permanent magnet 3 in a cantilever fasion, the magnet being magnetized in the axial direction of the stylus arm 2 and secured to a holder of the cartridge whereby a vibratory system is formed. In a plane in which magnet 3 lies, there is disposed a yoke 4 having three legs 4*a*, 4*b* and 4*c* so that legs 4*a* and 4*b* are positioned to face the lateral sides of magnet 3, and leg 4*c* is positioned above magnet 3, the legs 4*a* to 4*c* being surrounded by coils 5*a* to 5*d*.

FIG. 3 illustrates another typical example of the well-known pickup cartridge similar to the above-described pickup cartridge in FIGS. 1 and 2 except in that its yoke 6 has three legs 6*a*, 6*b*, and 6*c* of a short channel shape, of which webs extend horizontally to the lateral sides and upper side of magnet 3, and are surrounded by coils 5*a* to 5*d*.

In such pickup cartridges, when magnet 3 is angularly moved about a central point thereof as a fulcrum which is on the center axis of magnet 3, an electrical signal corresponding to the horizontal component of the magnet motion is induced in coils 5*a* and 5*b*, and an electrical signal corresponding to the vertical component thereof is induced in coils 5*c* and 5*d* due to the relationship in position between magnet 3 and legs 4*a* to 4*c* (6*a* to 6*c*). Therefore right and left channel signals can be derived by connecting coils 5*a* and 5*c* so that a sum of the signals induced therein may be produced, and by connecting coils 5*b* and 5*d* so that a difference between the signals induced therein may be produced. In these pickup cartridges the casing thereof does not project downwardly since any leg of the yoke is not provided below magnet 3, and thus stylus arm 2 can be shortened.

In contrast with the above advantages, this type of pickup cartridge has the following disadvantage due to the above-described structure having no lower pole piece. Although when magnet 3 vibrates horizontally there is no problem, when it vibrates vertically, legs 4*a* and 4*b* (6*a* and 6*b*) of yoke 4 for detecting the horizontal signal are used as parts of a magnetic circuit as shown in FIGS. 4 and 5 and hence a magnetic flux corresponding to the vertical vibratory motion of magnet 3 leaks into those legs 4*a* and 4*b*. Thus, in the pickup cartridge of the type in which the sum of and the difference between the vertical signal and the horizontal signal are produced to derive right and left channel signals, it is inevitable to encounter a problem in that a cross talk is generated between the right and left channels

SUMMARY OF THE INVENTION

Accordingly, it is an object of the present invention to provide a pickup cartridge of the moving magnet type in which a cross talk can be largely reduced to thereby derive correctly right and left channel signals.

This and other objects in view the present invention provides a pickup cartridge of the moving magnet type comprising: a vibratory system including; a stylus arm being carried in a cantilever fashion on holding means, a stylus being provided at a free end of said stylus arm, and a permanent magnet being provided at a fixed end of said stylus arm, said magnet being magnetized in a direction of an axis of said stylus arm; and a magneto-electric converting system including; stationary core means for flowing a magnetic flux, said core means having first, second, and third yoke members being magnetically coupled at their one pole ends to each other and faced at the other pole ends to a peripheral surface of said permanent magnet with gaps, said first and second yoke members being disposed so that their other pole ends face respective lateral sides of the magnet, and said third yoke being disposed so that its other pole end faces an upper periphery of said magnet; and coils being wound around the core means and being electrically connected so that electrical signals which are induced in the coils when said magnet is vibrated are derived from the coils, said coils including at least two sets of coils, one set of coils producing a sum of a horizontal signal and a vertical signal corresponding respectively to a horizontal component and a vertical component of the magnet vibration, the other set of coils producing a difference between the horizontal and vertical signals, and said coils, wound around the first and second yoke members, of each set of the coils being electrically connected to add signals induced therein when a magnetic flux flows circularly through a magnetic circuit including the first and the second yoke members, and the magnet.

BRIEF DESCRIPTION OF THE DRAWINGS

While the specification concludes with claims which particularly point out and distinctly define the subject matter which is regarded as the invention, it is believed the invention will be more clearly understood from the following detailed description and the accompanying drawings, in which:

PREFERRED EMBODIMENTS OF THE INVENTION

Figure 1:
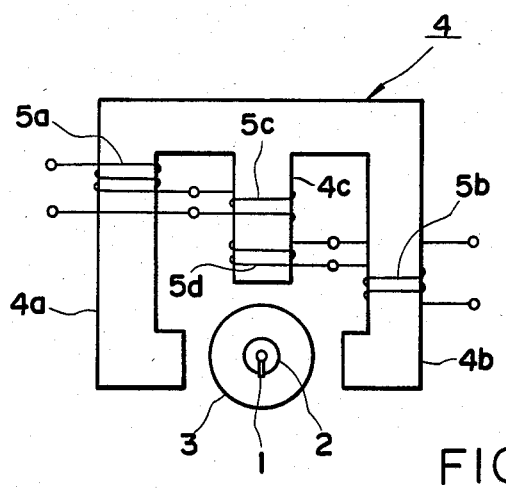
FIG. 1 PRIOR ART
FIG. 1 is a front view of a typical example of the prior art.
Figure 2:
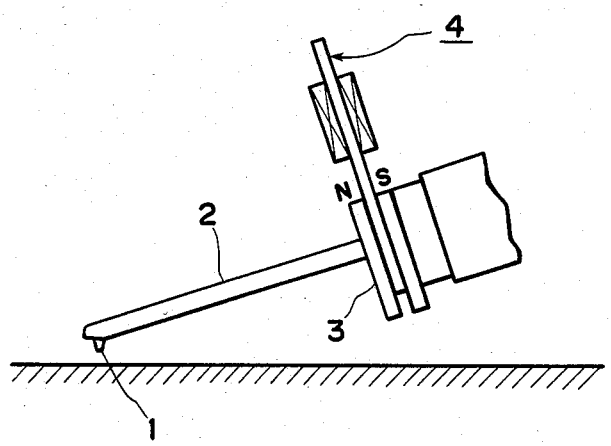
FIG. 2 PRIOR ART
FIG. 2 is a side view of the example in FIG. 1.
Figure 3:
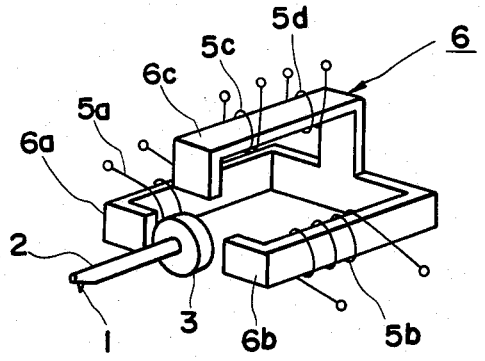
FIG. 3 PRIOR ART
FIG. 3 is a perspective view of another typical example of the prior art.
Figure 4:
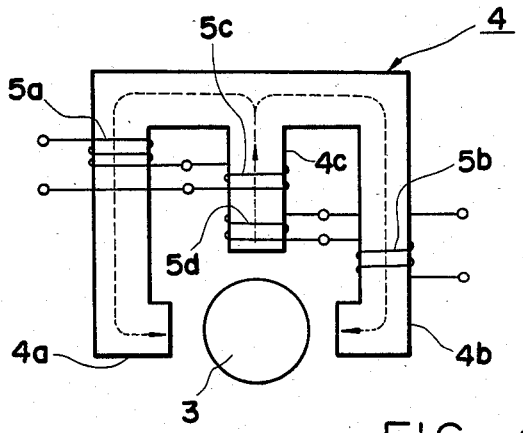
FIG. 4 PRIOR ART
FIG. 4 is a view showing magnetic circuits in the example in FIG. 1.
Figure 5:
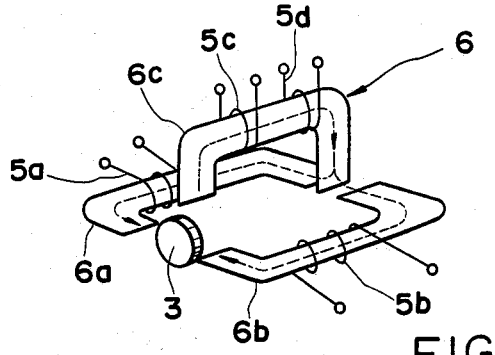
FIG. 5 PRIOR ART
FIG. 5 is a view showing magnetic circuits in the example in FIG. 3.
Figure 6:
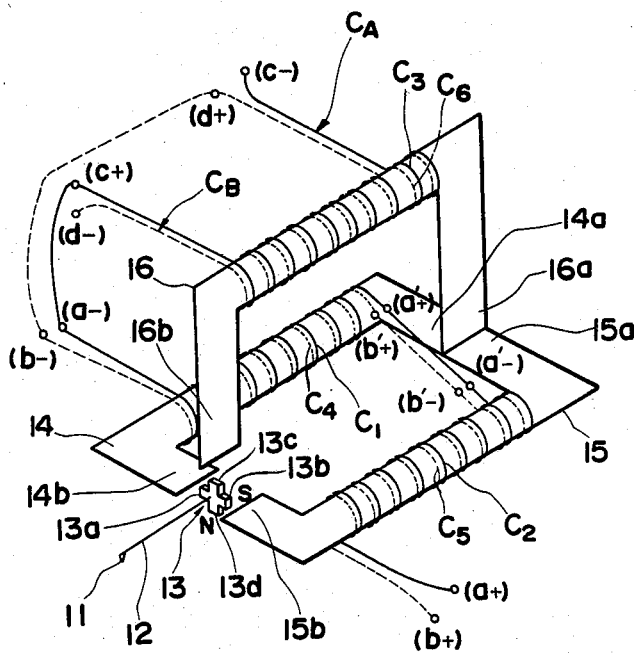
FIG. 6 is a diagrammatic illustration of the principle of the present invention.

Referring to FIG. 6 there is illustrated a principal construction of the present invention, in which a stylus arm 12 having a stylus 11 at its distal end is perpendicularly secured at its proximal end to a planar permanent magnet 13 in a cantilever fashion to form a vibratory system. The magnet 13 is of a cross shape having two vertically extending hands 13*c* and 13*d* and two horizontally extending hands 13*a* and 13*b*, and is supported through a damper 17 by a holder 18 (see FIG. 8) so as to be angularly movable in any plane containing the axis of stylus arm 12 about a point on the axis of magnet 13. The magnet 13 is magnetized in the axial direction of the stylus arm 12 with N and S poles indicated in FIG. 6.

Around and on the rear side of magnet 13 there are disposed generally U-shaped first, second and third yoke members 14, 15 and 16 which are magnetically coupled together at their rear pole ends 14*a*, 15*a* and 16*a*. The first and second yoke members 14 and 15 are disposed in a horizontal plane to face each other so that their front pole ends 14*b* and 15*b* are faced to end faces of the hands 13*a* and 13*b* of the magnet 13 respectively with gaps. Third yoke member 16 is disposed substantially centrally between and above first and second yoke members 14 and 15 so that a front pole end 16*b* of the third yoke member 16 faces the upper end of the hand 13*c* of the magnet 13 to form a gap.

The yoke members 14, 15 and 16 are respectively surrounded by a pair of coils $C_1$ and $C_4$, and $C_2$ and $C_5$, and $C_3$ and $C_6$, one of each pair being indicated by solid lines and the other by broken lines in FIG. 6. When the magnet 13 vibrates and causes a flux flowing through each yoke member to vary, corresponding electrical signals are induced in the coils $C_1$ to $C_6$. In this event, horizontal signals corresponding to a horizontal vibratory motion component of the magnet 13 are induced in the coils $C_1$, $C_2$, $C_4$, and $C_5$, and vertical signals corresponding to vertical vibratory motion component thereof are induced in the coils $C_3$ and $C_6$. As already described, the right and left channel signals can be derived by obtaining a sum of horizontal and vertical signals thus induced and a difference between them. To achieve this, the coils $C_3$, $C_1$ and $C_2$ are connected in series by connecting their terminals c+, a'+ to terminals a− and a'− respectively to thereby form a first set of coils $C_A$, shown in FIG. 6 by the solid lines, having opposite terminals a+ and c−, whilst the coils $C_6$, $C_4$ and $C_5$ are connected also in series by connecting their terminals d+, and b'+ to terminals b− and b'− respectively to thereby form a second set of coils $C_B$, shown by the broken lines, having opposite output terminals b+ and d−. The first coil set $C_A$ provides the sum of the vertical signal and the horizontal signal, and the second coil set $C_B$ provides the difference between them. The coils $C_1$ and $C_4$, and $C_2$ and $C_5$ which are respectively wound around first and second yoke members 14 and 15 are electrically connected so that when a magnetic flux flows the yoke members 14 and 15 in a counterclockwise direction as shown by the arrow in FIG. 7(A) or in the reverse direction, corresponding signals induced in the coils $C_1$ and $C_2$, and $C_4$ and $C_5$ of each coil set are added.

Referring to FIGS. 7(A) to (D) the operation of the pickup cartridge thus constructed will be explained.

Figure 7A:
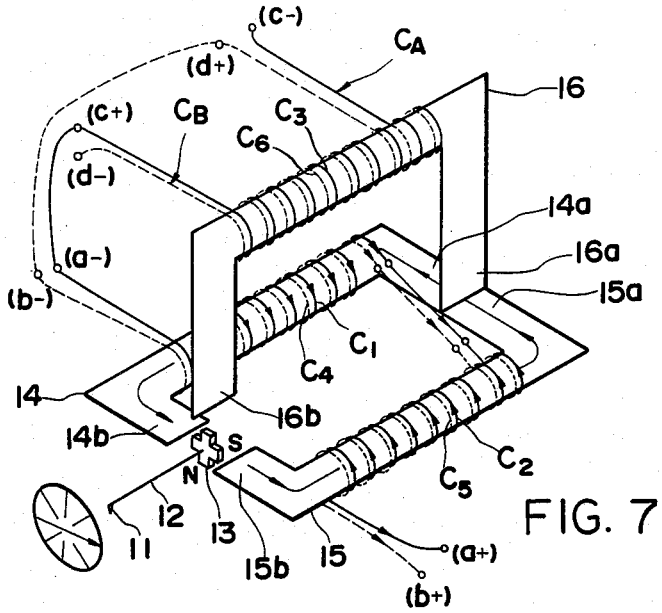
FIGS. 7(A) to 7(D) is a diagrammatical view illustrating the operation of the present invention.

(i) When the stylus is in engagement with a 45-45 stereophonic record and vibrated horizontally, it causes the magnet 13 to be moved toward the front pole end 14*b* of yoke member 14 or the front end 15*b* of yoke member 15. For example, when the magnet 13 is moved toward the front pole end 15*b* of yoke member 15 as shown in FIG. 7(A), a magnetic flux flows a magnet circuit including the magnet 13, and the first and second yokes 14 and 15 in a counterclockwise direction, namely, it flows from the N pole of the magnet 13 through the front end 15*b* of second yoke member 15 into the latter, then flows from the rear end 15*a* into the first yoke member 14, and finally returns from the front end 14*b* of first yoke member 14 to the S pole of the magnet 13. As a result, signal currents are induced in the arrow directions in FIG. 7(A) in the coils $C_1$ and $C_4$, and $C_2$ and $C_5$ wound around the first and second yoke members 14 and 15 respectively. More exactly, an increase in density of the magnetic flux in the arrow direction provides signal currents induced in directions as shown in FIG. 7(A), whereas a decrease in that provides signal currents induced in directions reverse to the directions shown therein. When the magnet 13 moves in the reverse direction, i.e., toward the front end 14*b* of yoke member 14, signal currents in directions reverse to the directions shown in FIG. 7(A) are induced in the coils $C_1$, $C_2$, $C_4$, and $C_5$. In both cases, the vertical component of the movement of the magnet 13 is zero, and thus little magnetic flux flows through the third yoke member 16, so that no signal is induced in the coils $C_3$ and $C_6$. Electrical signals induced in the coils $C_1$ and $C_2$, and $C_4$ and $C_5$ of each coil set are added and may be derived as a horizontal signal. The sum of the horizontal signal and the vertical signal (the vertical signal is zero in this case) and the difference between them are output from the first set of coils $C_A$ and the second set of coils $C_B$ respectively.

Figure 7B:
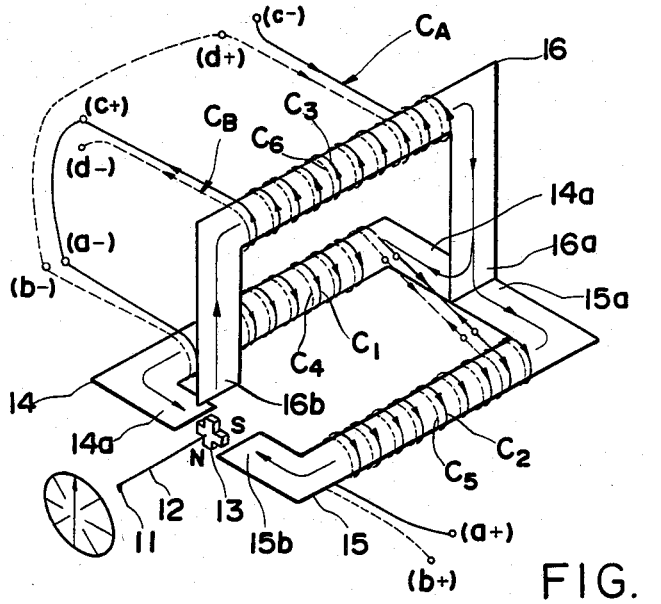

(ii) When the magnet 13 vertically moves, for example, when it moves toward the front pole end 16*b* as shown by the arrow in FIG. 7(B), the magnetic flux flows from the magnet 13 to the front pole face 16*b* of third yoke member 16 and then to the rear pole end 16*a* of third yoke member 16 where it is bifurcated into two parts, one of which returns through the yoke member 14 to the magnet 13 and the other of which returns through the yoke member 15 to the magnet 13. As a result, vertical signals are induced in the coils $C_3$ and $C_6$ of the third yoke member 16.

In this event the magnetic fluxes flow through the first and second yoke members 14 and 15 as described above, and hence signals are induced also in the coils $C_1$, $C_2$, $C_4$ and $C_5$ wound around the yoke members 14 and 15. According to the prior art these signals are, as hereinbefore described, detected as horizontal signals and cause a cross talk to be generated, but according to the present invention such drawback is sufficiently eliminated. Specifically, the coils $C_1$ and $C_2$, and $C_4$ and $C_5$, for detecting horizontal signals, of each coil set are electrically connected so that signals induced therein are added when a magnetic flux flows circularly through a magnetic circuit including the magnet 13 and the first and second yoke members 14 and 15, and accordingly, when the bifurcated fluxes flow, as in FIG. 7(B), through the first and second yoke members 14 and 15 in opposite directions to each other, the electrical signals induced in the coils $C_1$ and $C_2$, and $C_4$ and $C_5$ of each coil set are opposite in polarity and hence are cancelled by summation. Thus, any noise, which is in the prior art inevitably developed as the horizontal signal during the detection of the vertical signal, is removed. Therefore, the first coil set $C_A$ provides the sum of the vertical signal and the horizontal signal which is zero in the case shown in FIG. 7(B), and the second coil set $C_B$ outputs the difference between the vertical and horizontal signals.

Figure 7C:
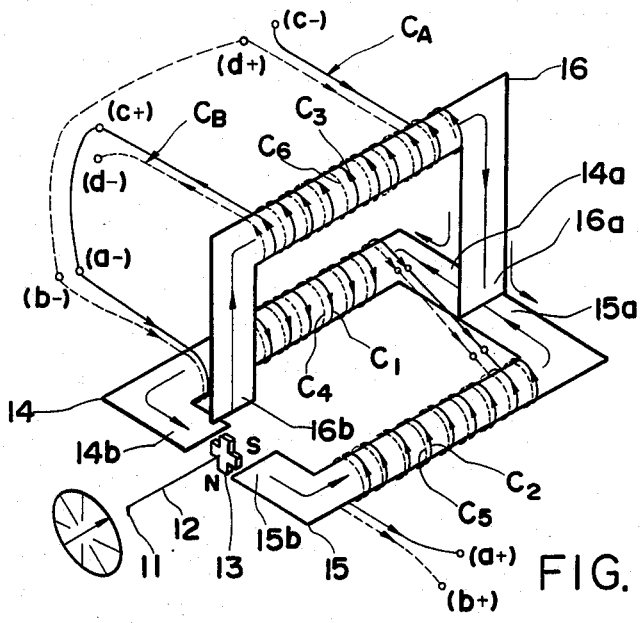

(iii) When the magnet 13 vibrates diagonally upwards to the right, for example, as shown by the arrow in FIG. 7(C), a vertical component of the magnet movement is detected as vertical signals by the coils $C_3$ and $C_6$ wound around the third yoke member 16. In this event signals corresponding to fluxes leaked from the third yoke member 16 into the first and second yoke members 14 and 15 are induced in the coils $C_1$, $C_2$, $C_4$ and $C_5$, but they are cancelled according to the principle of the present invention and are not detected. Thus, the exact sum of the horizontal signal and the vertical signal is derived from the first coil set $C_A$, and the exact difference between them are derived from the second coil set $C_B$. Therefore, also in this case right and left channel signals having little cross talk are derived.

When the magnet 13 moves diagonally downwards to the left, the exact sum of and difference between the vertical and horizontal signals are also derived from the first coil set $C_A$ and the second coil set $C_B$ respectively although in this event fluxes which flow through the yoke members 14, 15 and 16 and current induced in the coils $C_1$ to $C_6$ flow in directions opposite to those in FIG. 7(C).

Figure 7D:
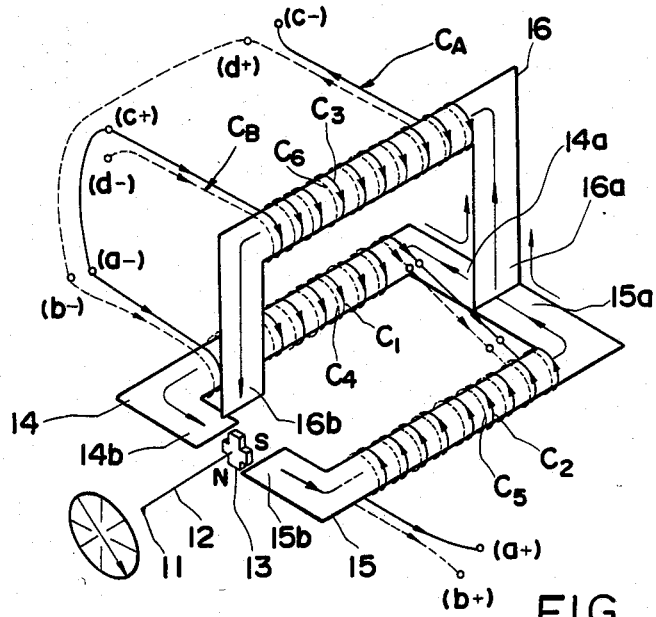

(iv) When the magnet 13 is moved diagonally downwards to the right as in FIG. 7(D) or upwards to the left, horizontal signals corresponding to a horizontal component of the magnet vibratory motion are detected by the coils $C_1$, $C_2$, $C_4$ and $C_5$ wound around the first and second yoke members 14 and 15, and a vertical signal corresponding to a vertical component of the magnet motion is detected by the coils $C_3$ and $C_6$ wound around the third yoke member 16. Also in this case noises due to vertical component signals produced in the coils $C_1$, $C_2$, and $C_4$ and $C_5$ for detecting horizontal signals are cancelled, and the horizontal and vertical signals are exactly separated. Thus, right and left channel signals having little cross talk are derived from the coil sets $C_A$ and $C_B$.

Figure 8:
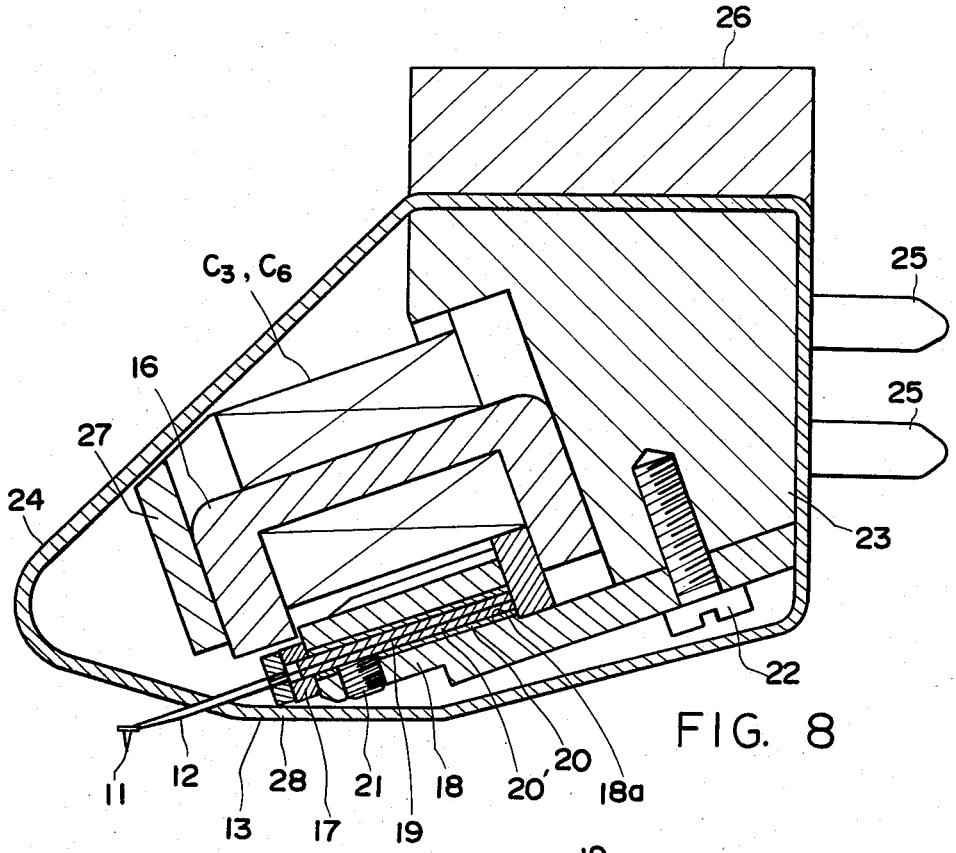
FIG. 8 is a vertical section of a pickup cartridge according to one embodiment of the present invention.
Figure 9:
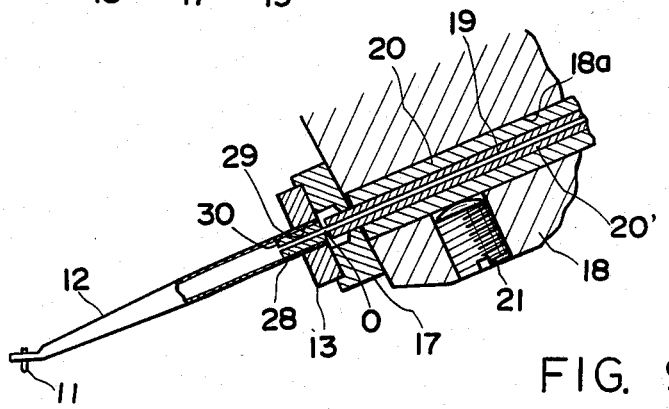
FIG. 9 is an enlarged view of a vibratory system in FIG. 8.
Figure 10:
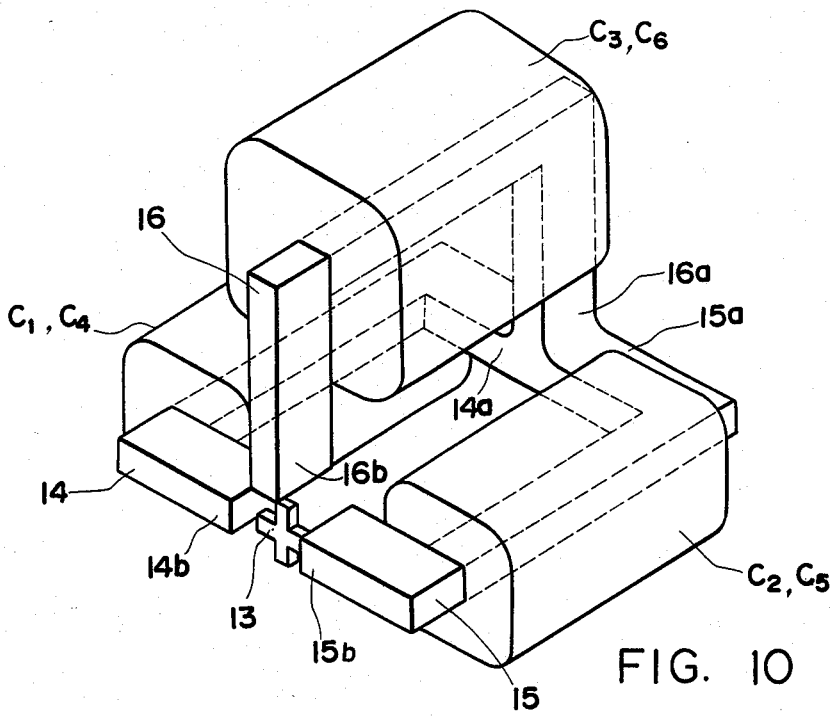
FIG. 10 is a perspective view of the main components of the pickup cartridge in FIG. 8.
Figure 11:
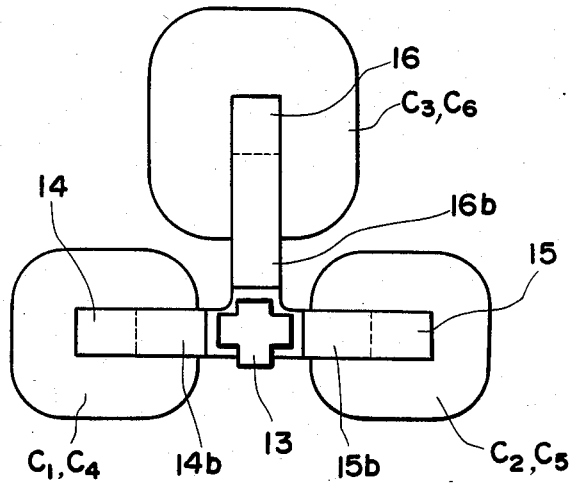
FIG. 11 is a front view of the main components in FIG. 10.

Now, referring to FIGS. 8 to 11, there is illustrated one embodiment of the present invention adopting the above-described principle. As clearly shown in FIG. 9, a stylus arm 12 is fixedly attached at its proximal end to a magnet 13 in alignment with each other by fitting a plug member 28 of a synthetic resin, which is tightly fitted into a center bore 29 of the magnet 13 and into a center bore 30 of the stylus arm 12. A tension wire 19 is embedded at its one end into the plug member 28 and fixedly secured to it. A larger part of the tension wire 19 is fixedly embedded in a holder 20' of a brass, which passes through a center hole formed through a damper 17 and is inserted into a bore 18*a* formed through a holder 18 via a holder 20 of a brass, where the holder 20' is fastened by a screw 21 with the tension sire 19 being placed under tension. The holder 20 and 20' are operable as a tension wire holder. Thus, the rear faces of hands 13*a* to 13*d* of magnet 13 is placed in abutment against damper 17 with a slight deformation of the latter. With such construction, stylus 11, stylus arm 12, and magnet 13 form a vibratory system and are arranged to vibrate about a point O (FIG. 9) which is on tension wire 19 and substantial centrally between the rear face of magnet 13 and the front face of holder 20'. The holder 18 is fastened to a base member 23 of the cartridge by a fixing screw 22. As clearly seen from FIGS. 10 and 11, around and on the rear side of the magnet 13 there are, according to the above-described principle of the present invention, disposed first and second yoke members 14 and 15 for detecting the horizontal signal and third yoke member 16 for detecting the vertical signal. The base member 23 is provided with three yoke holders 27, only one of which is shown in FIG. 8 and by means of which corresponding yoke members 14, 15 and 16 are secured to the base member 23 in position. Coils $C_1$ to $C_6$ are electrically connected to output plug pins 25 and 25. A reference numeral 24 designates a magnetic shielding casing for covering the above-mentioned main components of the pickup cartridge, and shielding casing 24 is mounted to a bracket 26.

In the above-described embodiment, the magnet 13 is of a cross shape and the rear surface thereof is placed in abutment with the damper 17, and thus the lower hand 13*d* of magnet 13 is always in contact with the damper 17 during the downward vibratory motion of the magnet 13, which affords even vertical vibration characteristic to the vibratory system when it is vibrated vertically whereas a vibratory system using a magnet of an inverted T shape which has no lower hand gives less even characteristic to the vibratory system when it is vertically vibrated. However, the magnet 13 may be of an inverted T shape or a disc shape.

Further, the yoke members 14 to 16 are disposed at equal angular intervals of 90° with respect to the axis of stylus arm 12 with the pole ends 14*b* and 15*b* of yoke members 14 and 15 being opposedly positioned on the lateral sides of the magnet 13 and the pole end 16*b* of third yoke member 16 being positioned above the magnet 13. However, the yoke members 14 to 16 are not restricted to such disposition.

Although the yoke members 14 to 16 are each surrounded by two coils for separately deriving vertical and horizontal signals, they may be each provided with more than two coils in order to detect the other signals.

What is claimed is:

1. A pickup cartridge of the moving magnet type comprising;

a vibratory system including;

a stylus arm carried in a cantilever fashion on holding means, a stylus provided at a free end of said stylus arm, and a permanent magnet provided at a fixed end of said stylus arm, said magnet being magnetized in a direction of an axis of said stylus arm; and a magnetoelectric converting system including;

stationary core means for flowing a magnetic flux, said core means having first, second and third yoke members magnetically coupled at their one pole ends to each other and faced at the other pole ends to a peripheral surface of said permanent magnet with gaps, said first and second yoke members being disposed so that their other pole ends face respective lateral sides of said magnet, and said third yoke member being disposed so that its other pole end faces an upper periphery of said magnet, and coil means wound around said core means and being electrically connected so that electrical signals which are induced in said coil means when said magnet is vibrated are derived from said coil means, said coil means including at least two sets of coils, each set having coil members wound around each of said first, second and third yoke members, said coil members wound around said first and second yoke members generating a horizontal signal corresponding to a horizontal component of the magnet vibration and said coil members wound around said third yoke member generating a vertical signal corresponding to a vertical component of the magnet vibration, one set of said coil means being electrically connected so as to produce a sum of the horizontal signal and the vertical signal, the other set of said coil means being electrically connected so as to produce a difference between the horizontal and vertical signals, and said members wound around said first and second yoke members of each set of said coil means being electrically connected so as to add signals induced therein when a magnetic flux flows circularly through a magnetic circuit including said first and second yoke members and said magnet.

2. A pickup cartridge as recited in claim 1, wherein in each set of the coil means, the coil members wound around the second, first, and third yoke members are electrically connected in series in the described order.

3. A pickup cartridge as recited in claim 2, wherein the first and the second yoke members are disposed to horizontally face each other at their other pole ends through the magnet.

4. A pickup cartridge as recited in claim 3, wherein the third yoke member is disposed to face at its other pole end a top portion of the magnet.

5. A pickup cartridge as recited in claim 4, wherein the core means is a yoke having three legs which correspond to the first, second, and third yoke members respectively.

6. A pickup cartridge as recited in claim 5, wherein the three legs of the yoke are of substantially a channel shape, and are disposed so that webs thereof extend in parallel with the axis of the stylus arm in a static condition of the stylus arm.

7. A pickup cartridge as recited in claim 1, wherein said magnet is of a cross shape having its hands extending vertically and horizontally.

8. A pickup cartridge as recited in claim 7, wherein said holding means includes: a tension wire having its one end fixed to said stylus arm and the other end fixed to a holder under tension via a tension wire holder; and a damper interposed between said magnet and said holder.

9. A pickup cartridge as recited in claim 8, wherein said vibratory system is arranged to vibrate about a point which is on said tension wire and centrally between said magnet and said tension wire holder.

* * * * *